US005087163A

United States Patent [19]

Erdbories et al.

[11] Patent Number: 5,087,163

[45] Date of Patent: Feb. 11, 1992

[54] STITCHING PRESS FOR BOOK BLOCKS

[75] Inventors: Ulrich Erdbories, Rahden; Gerhard Grannemann, Petershagen; Horst Rathert, Minden, all of Fed. Rep. of Germany

[73] Assignee: Kolbus GmbH & Co. KG, Rahden, Fed. Rep. of Germany

[21] Appl. No.: 602,741

[22] Filed: Oct. 24, 1990

[51] Int. Cl.[5] ..... B42B 2/02

[52] U.S. Cl. ..... 412/35; 412/9; 412/33

[58] Field of Search ..... 412/35, 33, 9

[56] References Cited

U.S. PATENT DOCUMENTS 4,041,883 8/1977 Meratti ..... 412/35 X 4,704,973 11/1987 Horst ..... 112/21

FOREIGN PATENT DOCUMENTS 3325173 1/1984 Fed. Rep. of Germany .

*Primary Examiner*—Paul A. Bell

*Attorney, Agent, or Firm*—Chilton, Alix & Van Kirk

[57] ABSTRACT

A press for stitching book block sections employs a transport system for transporting book sections to a stitching station. Carriages are mounted to an endless conveyor. A saddle is pivotally mounted to each of the carriages. The book sections are received on the saddle and transported to the stitching station in a continuous fashion. The pivotal swing of the saddles is controlled by rollers engaging cam paths as the conveyor is circulated.

20 Claims, 2 Drawing Sheets

STITCHING PRESS FOR BOOK BLOCKS

BACKGROUND OF THE INVENTION

This invention relates generally to stitching presses which are employed to threadably stitch sections to form book blocks. More particularly, the present invention relates to automated machines which include a station for stitching book block sections and an automatic conveyor system for transporting the book block sections to the stitching station.

In stitch press systems to which the invention relates, book block sections are transported in semi-continuous fashion and selectively positioned in the operating area of a sewing or stitching head. A feeding apparatus comprises a conveyor system to accurately position the book sections and to feed the book sections to the sewing head in a rapid high-output fashion. In conventional systems, the sewing needles and hook needles of the sewing head are frequently subjected to bending stresses due to the interface with the high speed feeding apparatus. The bending stresses frequently result in premature wear of the needles and in the enlargement of the holes punched by the needles. The book block spline may thus tend to rise. The resulting book binding may be both susceptable to structural damage and aesthetically unpleasing.

SUMMARY OF THE INVENTION

Briefly stated, the invention in a preferred form is a press for stitching book block sections. The press comprises a stitching station and a conveyor system for receiving book block sections at a feed station and transporting the sections to the stitching station. The conveyor comprises an endless conveyor chain defining a conveyor path which changes general direction in the vicinity of the feeding station and the stitching station. Carriages are coupled to the conveyor at generally spaced fixed locations thereof. A saddle is pivotally connected to each of the carriages for receiving book sections and transporting the book sections.

The carriages are guided in radial and axial positions along portions of the conveyor path by means of rollers which traverse various associated cam paths. In addition, the pivotal swing of the saddles relative to the carriages is controlled by follower rollers which traverse associated paths. As the conveyor continuously moves along the conveyor path, the saddles swing to a first pivotal position at the feed station to acquire a book section and continue to the stitching station where the saddle momentarily dwells and assumes a second pivotal position. The saddle swings of the second pivotal position for release from the book section and subsequently returns to the feed station.

The saddles have a pair of receiving surfaces disposed at fixed relative acute angles. One of the receiving surfaces will be caused to have a generally vertical orientation at the stitching station and this surface swings to a non-vertical angle after the saddle leaves the stitching station. The receiving surface also pivoted in a counterclockwise direction in the feed zone as the conveyor moves in a clockwise direction. The saddle is disposed in both radial and axial offset relationships to the carriage. A pair of follower rollers is mounted opposite the carriage to guide the pivotal swing at the stitching station.

An object of the invention is to provide a new and improved stitching press for interconnecting sections of a book block.

Another object of the invention is to provide a new and improved stitching press which enhances the accuracy of positioning a book block section at a stitching head to thereby improve the quality of the stitching.

A further object of the invention is to provide a new and improved stitching press having an improved transport system for producing high quality bindery stitching in a reliable, high speed and efficient process.

Others objects and advantages of the invention will become apparent from the drawings and the specification.

DETAILED DESCRIPTION OF THE PREFERRED EMBODIMENT

Figure 2:
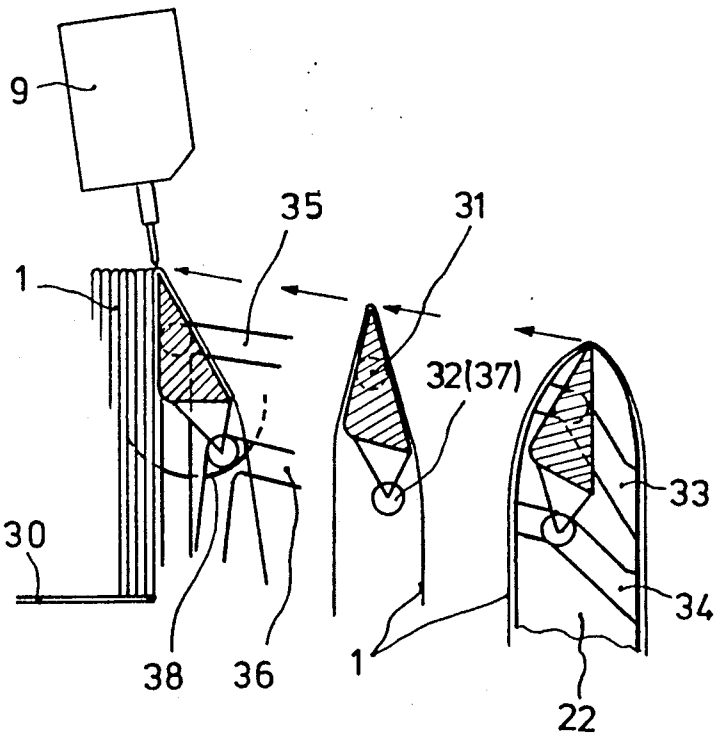
FIG. 2 is a fragmentary side view of the transport system and stitching press of FIG. 1, partly in schematic form, and viewed in the direction X of FIG. 3.

With reference to the drawings, wherein like numerals represent like parts throughout the figures, a stitching press is employed for threadably stitching book sections 1 to form book blocks. The stitching press has a transport system which receives book block sections 1 (at the left of FIG. 1) and transports the sections to the vicinity of a stitching head 9 wherein the book block sections 1 are interconnected by stitches. The stitched block sections stand upright in back-to-back relationship on delivery table 30 after the stitching operation. The stitching head 9 is generally of conventional form and function.

The transport system for the stitching press comprises an endless chain 6 which is continuously circulated around four sprockets 2–5 by means of a drive (not illustrated). The drive chain 6 circulates generally in the direction of the FIG. 1 arrow. The four sprockets 2–5 are relatively positioned so that lines connecting the rotational axes of the sprockets describe a four-sided polygon. The sprockets are driven by a variable speed drive. The transport path defined by the chain 6 may be described as a conveyor path which changes direction in the vicinity of the sprockets and in particular sprockets 2 and 3. One direction change at sprocket 3 occurs in the vicinity of the stitching head 9 whereby the conveyor path rises toward the stitching head and then traverses away from the stitching head in an obliquely inward orientation, i.e., the change of direction of the conveyor path is greater than 90° at the stitching station. As will be described below, the conveyor path configuration produces a comparatively long dwell phase time interval at the stitching station as a result of the longer path distance over which a direction change is produced in the vicinity of the stitching head.

A plurality of individual carriages 7 are connected to the chain 6 and are equidistantly spaced along the chain. A stitching saddle 8 is rotatably coupled to each carriage 7. The sewing saddles 8 are laterally offset with respect to the plane of movement of the carriages 7 as will be detailed below.

Figure 3:
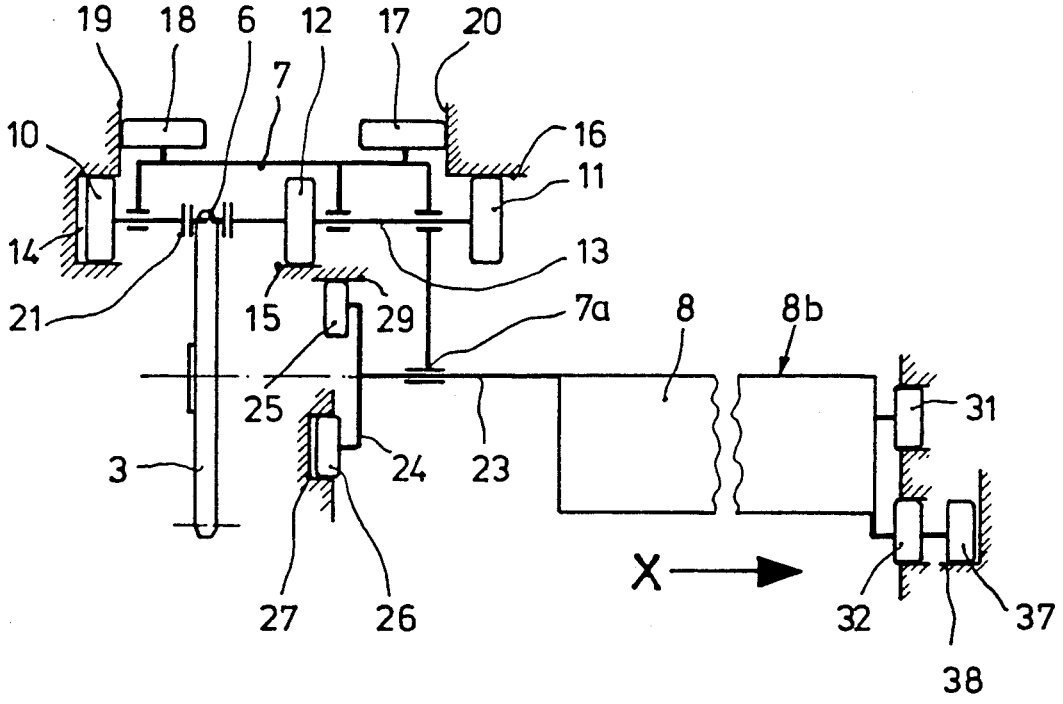
FIG. 3 is a schematic front elevational view, of an upper portion of the transport system of FIG. 1.

With reference to FIG. 3, each of the carriages 7 has pairs of vertical guide rollers 10 and 11 mounted at opposing ends of a pair of axles 13. Another pair of vertical guide rollers 12 is mounted on the axles 13 between rollers 10 and 11. The individual carriages 7 are positively guided in a first direction, i.e., in the radial direction of the sockets, by means of the guide rollers 10 which traverse a face cam 14, guide rollers 12 which traverse an interiorly intermediately located cam path 15, and guide rollers 10 which traverse a side-located cam path 16.

The carriages 7 also each have an additional pair of guide rollers 17 on one side of the carriage and an opposing pair of guide rollers 18 on the other side of the carriage. The rotational axes of rollers 17 and 18 are orthogonal to the rotational axes of rollers 10–12. The guide rollers 18 traverse a side track 19. The guide rollers 17 traverse a side track 20 which is adjacent and generally perpendicular to the cam path 16. The guide rollers 17 and 18 essentially function to provide a guidance for the carriage 7 in the axial direction of the sprockets.

Figure 1:
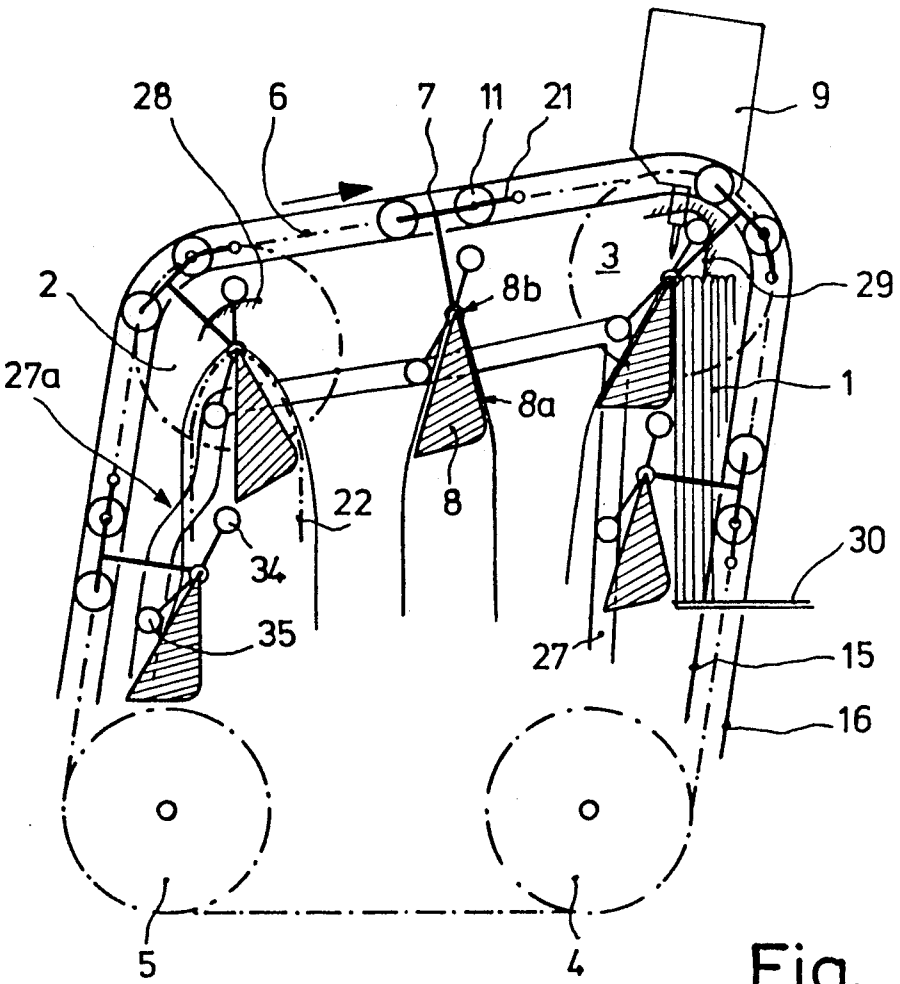
FIG. 1 is a side elevational view, partly in schematic, of a book block stitching press including a transport system in accordance with the present invention.

During the circulatory movement of the sprocket chain 6 via articulated-action traction links 21, the carriages 7 and their associated saddles 8 are positively guided in both the axial direction and the radial direction. The upper edge 8*b* of each stitching saddle is offset in relation to the sprocket chain 6 by a distance which corresponds to the radius of the sprockets 2 and 3, as shown in FIG. 1. Accordingly, the saddles 8 encounter a dwell phase at the feed zone in the region of sprocket 2 and at the stitching station in the operating region of the stitching head 9 while the sprocket chain continues to operate. The stitching head 9 functions to interlink the series of book block sections 1 at the stitching station which also constitutes a region of a change of direction of the conveyor path. Also, in the feed zone, the book block sections 1 are sequentially pushed onto the individual sewing saddles 8 from a feed saddle 22 at a second region wherein the conveyor sprocket chain changes direction in the vicinity of the sprocket 2. Thus, the saddle experiences a dwell time interval at both the feed zone position and the stitching station position of the transport system.

With additional reference to FIG. 3, each saddle 8 is rotatably suspended from a carriage 7 by means of a pivot-bearing pin 23. The pivot pin 23 is supported in an extension arm 7*a* of the carriage. The free end of the pivot-bearing pin 23 axially projects from the extension arm 7*a* and carries a diametrally disposed control lever 24. The control lever 24 is mounted in rotatably fixed relationship to the pivot pin 23. Two follower rollers 25 and 26 are mounted on the control lever 24 at opposed ends thereof. The rollers 24 and 25 are mounted for axis or rotation about axes which are oriented to the parallel pivot pin 23. Roller 26 travels on a face cam 27. Follower roller 25 comes into functional engagement with cam path segments 28 (FIG. 1) and 29 (FIGS. 1 and 2) respectively associated with sprockets 2 and 3. During the circulatory movement of the sprocket chain 6, the follower roller 25 successively engages the cam path segments 28 and 29 to essentially overcome a dead center position of the stitching saddle 8 as the direction of motion of the saddle changes.

The pivotal position of the saddle 8 is controlled by the follower roller 26 which is associated with the control lever 24. Follower roller 26 traverses the face cam 27 so that the saddle 8 describes a swinging movement counter to the clockwise running direction of the transport conveyor. At the stitching station, the leading supporting surface 8*a* of the sewing saddle is initially swung into a perpendicular position for performing the stitching operation while continuing to bear against the preceding book block section 1 which has just been stitched and is standing vertically on the delivery table 30. The sewing saddle is then swung backwards i.e., in a counter-clockwise direction, and guided out of the stitching station in a downward direction. The latter motion path causes the book section to release from the saddle 8. The empty saddle then returns to the feed zone.

The saddle 8 also describes a controlled swinging movement in the feed zone of the transport. An inward movement of the saddle 8 is produced by a curved section 27*a* of cam 27 (FIG. 1) which forces the supporting surface 8*a* to an inclined position with the sewing saddle 8 simultaneously swinging into the book block section from below. This swinging movement guarantees that the book block section is reliably transferred from the feed saddle 22 to the saddle 8 regardless of the format size of the book block. In addition, the high cycle rate of the transport system is maintained.

With reference to FIGS. 2 and 3, the stitching saddles 8 are guided in the vicinity of the stitching head 9 in order to perform the stitching operation, and in the vicinity of the feed saddle 22 in order to acquire the book block sections for transport to the stitching head. High quality stitching and functional reliability of the transport system is achieved by the guidance system for the transport system. Two spaced follower rollers 31 and 32 are mounted on the free end of the saddle 8 (FIG. 3). The follower rollers 31 and 32 traverse respective control paths 33 and 34 (FIG. 2) in the feed zone and traverses respective control paths 35 and 36 (FIG. 2) in the operating area of the stitching head 9. The courses described by the paths 33, 34, 35 and 36 correspond to the paths followed on the drive side. Each of the control paths 33–36 is enlarged to provide a widened entry section in order to ensure that the control rollers 31 and 32 enter the control paths in a reliable fashion.

A second control roller 37 is provided on the bearing axle of the lower control roller 32 in order to obtain the desirable dwell phase in the operating area of the stitching head 9 or at the stitching station. The second roller 37 is guided onto a control path 38 and, together with control roller 31, is maintained in position for a short period of time at the change of direction of the control path 36.

It will be appreciated that the movements of the saddles are positively guided and controlled in an efficient manner which ensures both a high degree of operational reliability and a high output feed/transport for the stitch press. Consequently, the book blocks may be formed in a rapid process which also ensures a high degree of binding quality for the book sections.

While a preferred embodiment of the foregoing invention has been set forth for purposes of illustration, the foregoing description should not be deemed a limitation of the invention herein. Accordingly, various modifications, adaptations, and alternatives may occur to one skilled in the art without departing from the spirit and the scope of the present invention.

What is claimed is:

1. In apparatus for stitching book block sections together to form book blocks, said apparatus including a book block section feed station and a stitching station, a sewing head being located at the stitching station, the improvement comprising:

conveyor means for receiving book block sections at the feed station and transporting said book block sections to the stitching station, said conveyor means comprising an endless conveyor which defines a transport path, said transport path changing direction in the vicinity of the feed station and the stitching station;

plural carriage means coupled to said conveyor means at spaced fixed locations thereof, motion being imparted to said carriage means by said conveyor means to cause said carriage means to move along said transport path;

a saddle means pivotally connected to each of said carriage means, said saddle means receiving book block sections and transporting said book block sections between the feed station and the stitching station, said saddle means each including a book block section engaging saddle;

guide means for controlling the position of said carriages in a pair of mutually orthogonal directions along at least portions of the path of motion thereof as said carrier means is moved by said conveyor means; and swing control means for controlling the angular position of said saddles relative to said carriage means, said swing control means causing said saddles to swing to a first pivotal position for intercepting a book block section at the feed station and to swing to a second pivotal position for stitching of the book block section at the sewing station.

2. The apparatus of claim 1 wherein said conveyor means operates continuously and wherein said guide means are configured to cause said saddle means to momentarily dwell at the feed and stitching stations.

3. The apparatus of claim 1 wherein said guide means comprises rollers mounted from said carriages and cam means defining a path along which said rollers travel.

4. The apparatus of claim 3 wherein said guide means comprises five pair of guide rollers associated with each of said carriage means.

5. The apparatus of claim 1 wherein said swing control means comprises at least a first roller connected to each of said saddle means and means defining at least a first non-linear swing control path, said rollers moving along said control path.

6. The apparatus of claim 1 further comprising:

table means for receiving and supporting book block sections in a generally vertical orientation at the stitching station; and wherein said saddles each comprise:

a generally wedge shaped member having at least a first receiving surface, said swing control means causing said receiving surface to have a generally vertical orientation at the stitching station, said swing control means further causing the saddle to pivot to place said receiving surface at a non-vertical orientation after the saddle leaves the stitching station.

7. The apparatus of claim 1 wherein said addles each have a receiving surface, said swing control means causing said receiving surfaces to be pivoted in a direction opposite to the direction of saddle travel at the feed station as said conveyor means causes said carriage means to move along said transport path.

8. The apparatus of claim 3 wherein said transport path defined by said conveyor means rises toward the location of the change of direction thereof in the vicinity of the stitching station and thereafter leads away from said change of direction location in an obliquely inclined downward direction.

9. The apparatus of claim 1 wherein said saddles each have an upper edge portion and wherein said conveyor means includes a pair of direction changing wheels which have substantially equal radii, the position of said saddle upper edge portions being offset with respect to said conveyor means defined transport path by a distance which is commensurate with said radius.

10. The apparatus of claim 1 wherein said swing control means comprises a pair of follower rollers connected to each of said saddles and means defining control tracks for said follower rollers, and wherein the saddles are disposed in an offset relationship with respect to associated carriage means.

11. The apparatus of claim 10 wherein said follower roller control tracks are located at least in the vicinity of the feed and stitching stations.

12. A press for stitching book block sections comprising:

stitching station means, said stitching station means including a sewing head for stitching together book block sections;

conveyor means for receiving book block sections at a feed station and transporting said book block sections in a first direction to said stitching station means, said conveyor means comprising an endless conveyor defining a transport path which changes direction in the vicinity of said stitching station means;

carriage means coupled to said conveyor means at generally spaced fixed locations thereof for movement along said transport path;

saddle means pivotally connected to said carriage means for receiving book block sections and transporting said book block sections;

guide means for guiding the motion of said carriage means in a pair of orthogonal directions along at least portions of said transport path, said guide means comprising a first plurality of follower rollers and cooperating means defining associated first guide paths for controlling the positions of said rollers of said first plurality; and swing control means for controlling the angular orientation of said saddle means relative to said carriage means, said swing control means comprising a second plurality of follower rollers and cooperating means defining associated second guide paths for controlling the positions of said rollers of said second plurality;

so that, as said conveyor means causes said carriage means to move continuously along said transport path, said saddle means will swing to a first pivotal position at the feed station to acquire a book block section and the said carriage means will continue to said stitching station means where the said saddle means will momentarily dwell and be caused to pivot to a second pivotal position, the said saddle means subsequently being caused to swing from said second pivotal position for release of the acquired book block section and thereafter returning to the feed station.

13. The press of claim 12 wherein said saddle means each have an upper edge portion and wherein said conveyor means includes a pair of direction changing wheels having a substantially equal radius, the position of said upper edge portions being offset with respect to said conveyor means defined transport path by a distance which is commensurate with said radius.

14. The press of claim 12 wherein said second plurality of rollers comprises a pair of follower rollers coupled to each of said saddle means and wherein said saddle means are axially disposed in an offset relationship with respect to said carriage means, at least one of said follower rollers of each said pair being guided in a portion of a said second guide path which is located in the vicinity of said stitching station means.

15. The press of claim 12 further comprising means for receiving and supporting stitched book block sections in a generally vertical orientation at said stitching stations means, and wherein said saddle means each comprise a saddle having a receiving surface, said swing control means causing said receiving surface to have a generally vertical orientation at said stitching station means and causing said receiving surface to be pivoted to a non-vertical angle after the saddle leaves said stitching station means.

16. The press of claim 12 wherein said saddle means each comprise a saddle having a surface, said surface being pivoted in a direction which is generally opposite to the direction of saddle movement in the vicinity of the feed station as said conveyor means causes the associated carriage means to move along said transport path.

17. A press for stitching book block sections comprising:

stitching station means, said stitching means including a sewing head for stitching together book block sections;

conveyor means for receiving book block sections at a feed station and transporting said book block sections in a first direction to said stitching station means, said conveyor means comprising an endless conveyor which defines a transport path which changes direction in the vicinity of said feed station and said stitching station means;

a plurality of carriages coupled to said conveyor means at generally spaced fixed locations thereof;

a saddle pivotally connected to each of said carriages, each saddle comprising a pair of receiving surfaces disposed at a fixed angle to one another for acquiring a book block section and transporting said book block section;

guide means for guiding said carriages at least along portions of said transport path, said guide means comprising a first plurality of path followers and means defining associated first guide tracks for controlling the positions of said followers of said first plurality; and swing control means for controlling the angular orientation of said saddle receiving surfaces relative to said carriages, so that, as said conveyor means causes said carriages to move continuously along said transport path, a saddle receiving surface is caused by said swing control means to swing to a first pivotal position at the feed station to acquire a book block section and the saddle then continues to said stitching station means where the said saddle momentarily dwells, said receiving surface is pivoted to a second pivotal position at said stitching station means, and the said saddle receiving surface is subsequently caused by said swinging control means to swing from said second pivotal position for release from the acquired book block section and return to the feed station.

18. The press of claim 17 wherein each said saddle further comprises an upper edge portion which interconnects said receiving surfaces, said conveyor means includes a first direction changing wheel having a first radius, and said saddle upper edge portions are offset with respect to said transport path by a distance which is commensurate with said first radius.

19. The press of claim 17 wherein said swing control means comprises a pair of follower rollers coupled to each of said saddles and means defining associated second follower paths at least in the vicinity of said stitching station means.

20. The press of claim 17 further comprising means for receiving and supporting stitched book block sections in a first angular orientation at said stitching station means, one of said saddle receiving surfaces being caused by said swing control means to have an angular orientation substantially equal to said first angular orientation at said stitching station means, said one receiving surface being pivoted form said first angular orientation after the saddle leaves said stitching station means.

* * * * *